US008788250B2

(12) United States Patent
Kaminsky et al.

(10) Patent No.: US 8,788,250 B2
(45) Date of Patent: Jul. 22, 2014

(54) METHOD OF IMPROVED RESERVOIR SIMULATION OF FINGERING SYSTEMS

(75) Inventors: Robert D. Kaminsky, Houston, TX (US); Adam S. Coutee, Missouri City, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 698 days.

(21) Appl. No.: 12/530,087

(22) PCT Filed: Apr. 8, 2008

(86) PCT No.: PCT/US2008/004538

§ 371 (c)(1),
(2), (4) Date: Sep. 4, 2009

(87) PCT Pub. No.: WO2008/150327

PCT Pub. Date: Dec. 11, 2008

(65) Prior Publication Data

US 2010/0106472 A1 Apr. 29, 2010

Related U.S. Application Data

(60) Provisional application No. 60/931,813, filed on May 24, 2007.

(51) Int. Cl.
*G06G 7/50* (2006.01)
*E21B 43/00* (2006.01)

(52) U.S. Cl.
CPC ..... *E21B 43/00* (2013.01)
USPC ..... 703/9; 703/2; 703/8

(58) Field of Classification Search
USPC ..... 703/2, 8–9
See application file for complete search history.

(56) References Cited

U.S. PATENT DOCUMENTS

| | | | |
|---|---|---|---|
| 2,412,765 | A | 12/1946 | Buddrus et al. |
| 4,008,764 | A | 2/1977 | Allen |
| 4,819,724 | A | 4/1989 | Bou-Mikael et al. |
| 5,025,863 | A | 6/1991 | Haines et al. |

(Continued)

FOREIGN PATENT DOCUMENTS

| | | |
|---|---|---|
| CA | 1015656 | 8/1977 |
| CA | 1059432 | 7/1979 |

(Continued)

OTHER PUBLICATIONS

Wolfsteiner et al. "Near-Well Radial Upscaling for the Accurate Modeling of Nonconventional Wells", SPE 76779, 2002, 6 pages.*

(Continued)

*Primary Examiner* — Suzanne Lo
(74) *Attorney, Agent, or Firm* — ExxonMobil Upstream Research-Law Department

(57) ABSTRACT

The present disclosure includes the use of grids composed solely or in part of a set of contiguous cells having six or more principal flow directions within a single layer is disclosed for use in numerical simulation. The grids are particularly well-adapted for use in modeling flow in hydrocarbon-bearing reservoirs where fingering or channeling is experienced. Methods of constructing a bisected periodic grid and a substantially constant width radial grid in connection with the present disclosure are also provided. The problem of grid orientation effects is lessened by providing grids with an increased number of principal flow directions, typically six or more. The improved grids may be used in many preexisting simulators.

17 Claims, 9 Drawing Sheets

(56) References Cited

U.S. PATENT DOCUMENTS

| | | | | |
|---|---|---|---|---|
| 5,407,009 | A | 4/1995 | Butler et al. | |
| 5,607,016 | A | 3/1997 | Butler | |
| 5,674,816 | A | 10/1997 | Loree | |
| 5,711,373 | A | 1/1998 | Lange | |
| 5,725,054 | A | 3/1998 | Shayegi et al. | |
| 5,740,342 | A | 4/1998 | Kocberber | |
| 5,771,973 | A | 6/1998 | Jensen et al. | |
| 6,039,116 | A | 3/2000 | Stevenson et al. | |
| 6,256,599 | B1 | 7/2001 | Tiribuzi | |
| 6,318,464 | B1 | 11/2001 | Mokrys | |
| 6,405,799 | B1 | 6/2002 | Vallejos et al. | |
| 6,823,297 | B2 | 11/2004 | Jenny et al. | |
| 6,941,255 | B2 | 9/2005 | Kennon et al. | |
| 7,006,959 | B1 | 2/2006 | Huh et al. | |
| 7,043,413 | B2 * | 5/2006 | Ward et al. | 703/10 |
| 7,096,122 | B2 * | 8/2006 | Han | 702/13 |
| 7,289,942 | B2 | 10/2007 | Yang et al. | |
| 7,363,973 | B2 | 4/2008 | Nenniger et al. | |
| 7,540,951 | B2 | 6/2009 | Selmen et al. | |
| 2005/0203725 | A1 | 9/2005 | Jenny et al. | |
| 2005/0273303 | A1 | 12/2005 | Flandrin et al. | |
| 2006/0025976 | A1 * | 2/2006 | Kennon et al. | 703/10 |

FOREIGN PATENT DOCUMENTS

| | | |
|---|---|---|
| CA | 1122115 | 4/1982 |
| CA | 2108723 | 4/1995 |
| CA | 2108349 | 8/1996 |
| CA | 2304938 | 2/2001 |
| CA | 2243105 | 11/2001 |
| CA | 2141112 | 11/2002 |
| CA | 2306016 | 11/2004 |
| CA | 2349234 | 12/2004 |
| CA | 2147079 | 10/2006 |
| CA | 2281276 | 2/2007 |
| CA | 2351148 | 7/2008 |
| CA | 2462359 | 5/2011 |

OTHER PUBLICATIONS

Aarnes, J. E. et al., "An Introduction to the Numerics of Flow in Porous Media Using Matlab", *Geometric Modeling, Numerical Simulation and Optimization: Applied Mathematics*, SIFTEF, 2007, pp. 1-42, Oslo, Norway.

Brand, C. W. et al., "The Grid Orientation Effect in Reservoir Simulation", SPE 21228, 11$^{th}$ SPE Symposium on Reservoir Simulation, Feb. 17-20, 1991, pp. 1-12, Anaheim, CA.

Chong, E. et al., "A Unique Grid-Block System for Improved Grid Orientation", SPE 88617, SPE Asia Pacific Oil & Gas Conference, Oct. 18-20, 2004, pp. 1-10, Perth, Australia.

Fu, Y., "Three-Dimensional, Three-Phase Discrete-Fracture Reservoir Simulator Based on Control Volume Finite Element (CVFE) Formulation", SPE 93292, SPE Reservoir Simulation Symposium, Jan. 31-Feb. 2, 2005, pp. 1-9, Houston, TX.

Haajizadeh, M. et al., "Effects of Phase Behavior, Dispersion and Gridding on Sweep Patterns for Nearly Miscible Gas Displacement", SPE 62995, SPE Annual Technical Conference, Oct. 1-4, 2000, pp. 1-15, Dallas, TX.

Palagi, C. L. et al., "Use of Voronoi Grid in Reservoir Simulation", SPE 22889, 1994, SPE Advanced Technology Series, pp. 69-77, V. 2, No. 2.

Palagi, C. L. et al., "Supplement to SPE22889—Use of Voronoi Grid in Reservoir Simulation, Appendices A, B, and C", SPE 26951, 1994, pp. 1-13.

Settari, A. et al., "Simulation of enhanced recovery projects-the problems and the pitfalls of the current solutions", The Journal of Canadian Petroleum Technology, Nov.-Dec. 1985, pp. 22-28, Montreal.

Wadsley, W. A., "Modelling Reservoir Geometry with Non-Rectangular Coordinate Grids", SPE 9369, 55$^{th}$ Annual SPE Fall Technical Conference, Sep. 21-24, 1980, pp. 1-14, Dallas, TX.

Watts and Silliman, "Selecting Grid and Timestep Sizes", *Reservoir Simulation*, SPE Monograph Series, Chapter 5, 1990, pp. 44-56, V. 13, Richardson, TX.

Zhang, H. R. et al., "Viscous fingering in five-spot experimental porous media: new experimental results and numerical simulation", *Chemical Engineering Science*, 1997, pp. 37-54, V. 52, No. 1, Elsevier Science Ltd., UK.

European Search Report No. 115572, Sep. 27, 2007, 3 pages.

Carey, G.F. (1997), "*Computation Grids: Generation, Adaptation, and Solution Strategies," Chapter 4*, pp. 185-214, 215-245.

Carey, G.F. (1997), "*Computation Grids: Generation, Adaptation, and Solution Strategies," Chapter 7*, pp. 367-402.

* cited by examiner

0°

15°

30°

45°

METHOD OF IMPROVED RESERVOIR SIMULATION OF FINGERING SYSTEMS

PRIORITY

This application is the National Stage of International Application No. PCT/US2008/004538, filed Apr. 8, 2008, which claims the benefit of U.S. Provisional Application No. 60/931,813, filed May 24, 2007.

BACKGROUND OF THE INVENTION

1. Field of the Invention

This disclosure relates generally to numerical models for computer simulation of flow in a porous medium. More particularly, a method for simulating flow when a low viscosity fluid is injected into a formation containing more viscous resident fluid is provided, when viscous fingering and channeling of the injected fluid becomes important.

2. Background

This section is intended to introduce the reader to various aspects of the art, which may be associated with exemplary embodiments of the present invention, which are described and/or claimed below. This discussion is believed to be helpful in providing the reader with information to facilitate a better understanding of particular aspects of the present disclosure. Accordingly, it should be understood that these statements are to be read in this light, and not necessarily as admissions of prior art.

In the primary recovery of oil from a subterranean, oil-bearing formation or reservoir, it is usually possible to recover only a limited proportion of the original oil present in the reservoir. For this reason, a variety of supplemental recovery techniques are used to improve the displacement or recovery of oil from the reservoir rock. These techniques can be generally classified as thermal recovery methods (such as steam injection operations) and a-thermal recovery methods. A-thermal methods can involve injecting either immiscible fluids (e.g., water floods) or miscible fluids (e.g., $CO_2$ floods or liquid solvent floods).

In miscible recovery operations, a soluble fluid (e.g. solvent) is injected into the reservoir to at least partially dissolve into the oil in place so that the oil can then be removed as a more highly mobile phase from the reservoir. The solvent is typically a light hydrocarbon such as liquefied petroleum gas (LPG), a hydrocarbon gas containing relatively high concentrations of aliphatic hydrocarbons in the $C_2$ to $C_6$ range, or carbon dioxide. Miscible recovery operations are normally carried out by a displacement procedure in which the solvent is injected into the reservoir through an injection well to displace the oil from the reservoir towards a production well from which the oil is produced. This provides effective displacement of the oil in the areas through which the solvent flows. Additionally, miscible recovery operations are sometimes cyclic in nature, where solvent is injected into the reservoir to invade and mix with the resident oil, and the resulting mixture is subsequently produced through the same well in which solvent was injected. Cyclic recovery operations typically consist of a number of injection and production cycles. For such miscible recovery operations, injected solvent often flows unevenly through the reservoir.

Because the solvent injected into the reservoir is typically substantially less viscous than the resident oil, the flow is often inherently unstable, which causes the solvent to finger and channel through the reservoir, leaving parts of the reservoir unswept. The unevenness of the sweep may be quite severe when the oil is highly viscous, such as the case of heavy oils and bitumens. Added to this fingering is the inherent tendency of a highly mobile solvent to flow preferentially through the more permeable rock sections.

The solvent's miscibility with the reservoir oil also affects its displacement efficiency within the reservoir. Some solvents, such as LPG, mix directly with reservoir oil in all proportions and the resulting mixtures remain single phase. Such solvent is said to be miscible on first contact or "first-contact miscible." Other solvents used for miscible flooding, such as carbon dioxide or hydrocarbon gas, form two phases when mixed directly with reservoir oil. Therefore, they are not first-contact miscible. However, at sufficiently high pressure, in-situ mass transfer of components between reservoir oil and solvent forms a phase with a transition zone of fluid compositions that ranges from oil to solvent composition, and all compositions within the transition zone of this phase are contiguously miscible. Miscibility achieved by in-situ mass transfer of the components resulting from repeated contact of oil and solvent during the flow is called "multiple-contact" or dynamic miscibility. The pressure required to achieve multiple-contact miscibility is called the "minimum-miscibility pressure." Solvents just below the minimum miscibility pressure, called "near-miscible" solvents, may recover oil nearly as well as miscible solvents.

Predicting performance of miscible recovery operations requires a realistic model representative of the reservoir. Numerical simulation of reservoir models is widely used by the petroleum industry as a method of using a computer to predict the effects of miscible displacement phenomena. In most cases, there is desire to model the transport processes occurring in the reservoir. What is being transported is typically mass, energy, momentum, or some combination thereof. By using numerical simulation, it is possible to reproduce and observe a physical phenomenon and to determine design parameters without actual laboratory experiments and field tests.

Reservoir simulation approximates the behavior of a real hydrocarbon-bearing reservoir from the performance of a numerical model of that reservoir. The objective of such simulations is to understand the complex chemical, physical, and fluid flow processes occurring in the reservoir sufficiently well to predict future behavior of the reservoir to maximize hydrocarbon recovery. Reservoir simulation often refers to the hydrodynamics of flow within a reservoir, but in a larger sense reservoir simulation can also refer to the total petroleum system which includes the reservoir, injection wells, production wells, surface flowlines, and surface processing facilities.

The principle of numerical simulation is to numerically solve equations describing a physical phenomenon by a computer, such as fluid flow. Such equations are generally ordinary differential equations and partial differential equations. These equations are typically solved by linearizing the equations and using numerical methods such as the finite element method, the finite difference method, the finite volume method, and the like. In each of these methods, the physical system to be modeled is divided into smaller gridcells or blocks (a set of which is called a grid or mesh), and the state variables continuously changing in each gridcell are represented by sets of values for each gridcell. In the finite difference method, an original differential equation is replaced by a set of algebraic equations to express the fundamental principles of conservation of mass, energy, and/or momentum within each gridcell and transfer of mass, energy, and/or momentum transfer between gridcells. These equations can number in the millions. Such replacement of continuously changing values by a finite number of values for each gridcell is called "discretization." In order to analyze a phenomenon changing in time, it is necessary to calculate physical quantities at discrete intervals of time called timesteps, irrespective of the continuously changing conditions as a function of time. Time-dependent modeling of the transport processes proceeds in a sequence of timesteps.

In a typical simulation of a reservoir, solution of the primary unknowns, typically pressure, phase saturations, and compositions, are sought at specific points in the domain of interest. Such points are called "gridnodes" or more commonly "nodes." Gridcells are constructed around such nodes, and a grid is defined as a group of such gridcells. The properties such as porosity and permeability are assumed to be constant inside a gridcell. Other variables such as pressure and phase saturations are specified at the nodes. A link between two nodes is called a "connection." Fluid flow between two nodes is typically modeled as flow along the connection between them.

Compositional modeling of hydrocarbon-bearing reservoirs is necessary for predicting processes involving first-contact miscible, multiple-contact miscible, and near-miscible solvent injection. The oil and gas phases are represented by multicomponent mixtures. In such modeling, reservoir heterogeneity and viscous fingering and channeling cause variations in phase saturations and compositions to occur on scales as small as a few centimeters or less. A sufficiently fine-scale model can represent the details of these adverse-mobility injection behaviors. However, use of fine-scale models to simulate these variations is generally not practical because their fine level of detail places prohibitive demands on computational resources. Therefore, a coarse-scale model having far fewer gridcells is typically developed for reservoir simulation. Considerable research has been directed to developing models suitable for use in predicting performance of miscible recovery operations.

Numerical simulation of fluid flow in permeable hydrocarbon-bearing formations is a critical tool for optimizing the recoveries and economics of oil and gas production from subsurface reservoirs. Although several classes of numerical simulation schemes exist for such problems, finite-difference methods are by far the most commonly utilized in the petroleum industry. In such methods, the region to be simulated is populated with nodes at specific coordinates and sets of flow connections between neighboring nodes. Together the nodes and connections constitute a "simulation grid."

Associated with each node is a subvolume of the simulation region (a "cell") for which the conditions (e.g., pressure, composition, temperature, etc.) at the node apply. Various methods exist for assigning subvolumes to nodes. One common method is the Perpendicular Bisection (PEBI) method (see, e.g., C. L. Palagi and K. Aziz, "Use of Voronoi Grid in Reservoir Simulation," SPE Advanced Technology Series, 2(2), 69-77, 1994). In this method, the line segments (for two-dimensional systems) or planar faces (for three-dimensional systems) defining the boundaries of a given subsection are orthogonal to and bisect the flow connections between neighboring nodes. The set of subvolumes forms a "cell pattern." It is noted that any border associated with the connection between two nodes is actually a bounding face consisting of a finite surface area. For simplicity, these bounding faces are referred to here as boundary line segments in the two dimensional sense.

For many finite difference schemes the specific solution can be very dependent on the grid geometry, especially for coarse grids. Two types of errors can result. First, calculated solutions may change depending on the orientation of the grid (i.e., whether the fluid flow is aligned with the node connections or not). This is called a "grid orientation" effect. For example, fluid flow may be artificially forced along directions aligned with node connections. And second, calculated solutions may exhibit suppression of flow fingering or channeling due to artificially enhanced dispersion lateral to the flow direction. This phenomenon is termed "artificial dispersion" and in certain circumstances may be related to grid orientation. See FIGS. 1A-1D for an example of grid orientation and finger suppression due to lateral flow dispersion. FIGS. 1A-1D depict simulated concentration profiles at a specific time for a low-viscosity miscible fluid displacing (from the left) a fluid with a viscosity 150 times greater. In each case the grid is composed of rectangular cells but the orientations are rotated relative to the flow direction at angles of 0°, 15°, 30°, and 45°. Finger suppression due to lateral flow dispersion increases as the flow becomes further misaligned with the grid direction.

Overviews of grid orientation effects and solutions involving modifications to the calculation methods are given by Brand et al. (SPE 21228, "The Grid Orientation Effect in Reservoir Simulation", 1991), Settari and Karcher (Journal of Canadian Petroleum Technology, "Simulation of enhanced recovery projects—the problems and pitfalls of current solutions", 22-28, November-December 1985), and Haajizadeh et al., (SPE 62995, "Effects of Phase Behavior, Dispersion and Gridding on Sweep Patterns for Nearly Miscible Gas Displacement", 2000).

Ideally, a simulation grid should not artificially favor flow in certain directions nor artificially enhance flow dispersion. Certain methods that address one of these problems can aggravate the other. For example, a cell pattern consisting of regular hexagons (hex-grids) may significantly reduce grid orientation effects as compared with square cell patterns. Hex-grids, however, have no principal flow directions (as will be discussed below) and thus tend to enhance lateral flow dispersion. This is typically not a major concern for systems where a less mobile fluid displaces a more mobile fluid (e.g., waterflooding a reservoir containing light oil). However, enhanced lateral dispersion may lead to serious prediction errors for systems where a more mobile fluid displaces or invades a less mobile fluid (e.g., solvent extraction of bitumen or $CO_2$ flooding of an oil reservoir). In such systems, fingering behavior is prone to occur where the more mobile fluid attempts to displace or invade the less mobile fluid. Enhanced lateral dispersion may artificially "blur-out" such fingers in a simulation, as illustrated in FIGS. 2A-2B, and thus fingers may inappropriately grow slower or not at all. FIGS. 2A-2B depicts simulated concentration profiles at a specific time for a low viscosity miscible fluid displacing (from the left) a fluid with a viscosity 150-times greater. The enhanced lateral dispersion in the hex-grids of FIG. 2A leads to inappropriately wide and short fingers compared to the rectangular grid of FIG. 2B. It is noted that the flow is aligned with the grid direction for the rectangular grid case.

A number of methods have been proposed which address both artificial grid orientation effects and flow dispersion effects (e.g., multipoint flux approximation methods and mixed finite element methods) (J. E. Aarnes, T. Gimse, and K.-A. Lie, "An Introduction to the Numerics of Flow in Porous Media using Matlab" in *Geometric Modeling, Numerical Simulation and Optimization: Applied Mathematics at SINTEF*, G. Hasle et al. (eds.), 2007), but typically they reduce computation speed or are not available in commonly used simulators. The methods described in the current invention can be readily implemented in simulators utilizing the common two-point flux approximation method.

A primary cause of grid orientation effects and enhanced lateral artificial dispersion can be physically understood in terms of fluid flow not being aligned with a "principal flow direction" of the chosen finite difference grid. "Principal flow direction" can also be designated as "low-dispersive flow direction," which describes a flow direction in the grid in which artificial dispersion is minimized. "Principal flow directions," or "low-dispersive flow directions" are those flow directions where: (1) the flow has no velocity component causing a portion of it to cross cell boundaries defining a channel and (2) the flow follows a channel of substantial constant width defined by cell boundaries combining to form straight lines across the grid—as illustrated by FIGS. 3A and 3B. Note that for certain grid patterns two or more cells may span a principal flow direction channel and thus dispersion may be enhanced within the channel but not across the boundaries of the channel. In radial grids, the channels are between radial lines. In other grids, the channels may be between parallel lines.

If a fluid flow direction is not aligned with a principal flow direction of the finite difference grid, the flow will repeatedly split and laterally disperse as it moves through a progression of cells. For example, a standard rectangular grid, as shown in FIG. 3A, has two principal flow directions (0° and 90°) and a standard triangular grid has three principal flow directions (0°, 60°, 120°), as shown in FIG. 3B. The degree to which the lateral dispersion occurs is proportional to the angular offset from the closest principal flow direction. Thus, grid orientation effects and enhanced dispersion effects are related. Additionally, artificially high lateral dispersion can occur if the flow directions correspond to cell channels which become progressively wider, which is typically the case in radial grids, as illustrated in FIG. 4. Thus, radial grids of the type illustrated in FIG. 4 are considered not to have any principal flow directions, as defined herein. Embodiments of the invention describe modified radial grids with cells forming channels of substantially constant width, or at least cells that have a limited variation of width.

Lateral dispersion may suppress flow fingering or channeling behavior, and thus if the dispersion is artificially enhanced due to the choice of cell pattern, physically incorrect behavior may be predicted for certain systems. Viscous fingering may occur in systems with a mobility ratio greater than one (i.e., displacing fluid mobility greater than displaced fluid mobility), where the mobility of a fluid is defined as the ratio of permeability it experiences to its viscosity. Such adverse mobility ratios can occur in commercially important light and heavy oil systems such as $CO_2$ flooding, water flooding, low concentration polymer flooding, and solvent injection heavy oil recovery methods. In such systems the mobility ratio may be greater than 1, 10, or even 100. Non-viscous types of fingering, or channeling, can occur in certain systems including those in systems which undergo fracturing (e.g., cyclic steam stimulation) and in systems with certain geological heterogeneities.

Chong, et al. (SPE88617, "A Unique Grid-Block System for Improved Grid Orientation", 2004), discuss a novel gridding method for reduction of grid orientation artifacts utilizing square and octagon cells. The method however is not suitable for viscous fingering systems since the grid does not address artificial lateral dispersion. Huh, et al. (U.S. Pat. No. 7,006,959) propose an approximation of mathematically splitting each cell into two cells to capture the fact that viscous fingers only displace fluid from a portion of the volume. The approximation, however requires additional simulation coding and involves adjustable parameters requiring tuning. Watts and Silliman (C. C. Mattax (ed.) and R. L. Dalton (ed.), *Reservoir Simulation*, SPE Monograph Series, Chapter 5, 1990) proposed a gridding method that results in four principal flow directions. The method is applicable in common simulators. The method, however, is not optimal.

Hence, a better method for modeling flow in a porous media is needed.

SUMMARY OF INVENTION

A method is provided for simulating flow in a porous medium by defining a grid comprising contiguous cells in one or more layers, where some portion of the grid has at least six principal flow directions, and solving linearized flow equations associated with the grid. The grid may be a bisected periodic grid or a substantially constant width radial grid. The disclosed methods are particularly well adapted for use in modeling flow in hydrocarbon-bearing reservoirs where fingering or channeling is experienced.

In another embodiment of the invention, a method for constructing a grid for use in numerical simulation is provided. The method includes constructing a structured non-radial grid; and for each original grid cell adding a line segment connecting two points on the grid cell perimeter so to divide the grid cell into two or more cells such that there are at least six principal flow directions across the structured grid. In exemplary embodiments of the method, the cells are hexagonal and the added line segments connect opposite vertices, or the cells being divided are rectangular and the added line segments connect points that are located at subdivisions of the edges where each edge is divided into an integer number of subsections.

In a third embodiment of the invention, a method of constructing a grid for use in numerical simulation is provided. The method includes constructing a standard radial grid having a center point and at least one ring, each ring having a plurality of cells, wherein the cells have at least a cell width; selecting a maximum cell width ($W_{max}$); determining if a cell has a width greater than $W_{max}$, wherein the determination is made one ring at a time starting at the ring closest to the center point of the grid; and introducing a new radial line starting from the ring having a cell with a width greater than $W_{max}$ and extending radially outward. In exemplary embodiments of the method, the new radial line extends to an outermost edge of the grid, and the determining step is repeated for each ring until the ring at the outermost edge of the grid is reached such that each of the plurality of cells in each of the at least one ring has a cell width less than $W_{max}$.

BRIEF DESCRIPTION OF THE DRAWINGS

FIG. 1 is an illustration of grid orientation effects in a system with four different rectangular grid orientations relative to flow direction.

DETAILED DESCRIPTION

Figure 1A:
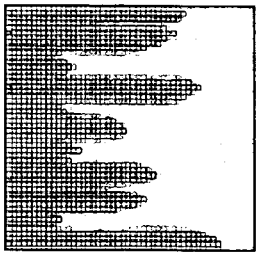
FIG. 1A is an illustration of fingering in a rectangular grid where the actual flow direction is the same as one principal flow direction.
Figure 1B:
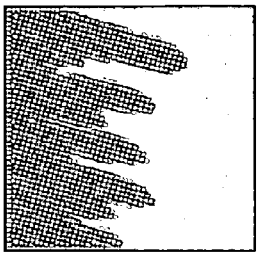
FIG. 1B is an illustration of fingering in the same system with a rectangular grid where the angle between actual flow direction and a principal flow direction is 15°.
Figure 1C:
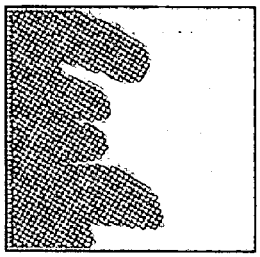
FIG. 1C is an illustration of fingering in the same system with a rectangular grid where the angle between actual flow direction and a principal flow direction is 30°.
Figure 1D:
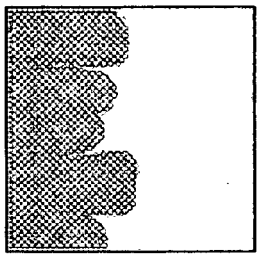
FIG. 1D is an illustration of fingering in the same system with a rectangular grid where the angle between actual flow direction and a principal flow direction is 45°.
Figure 2A:
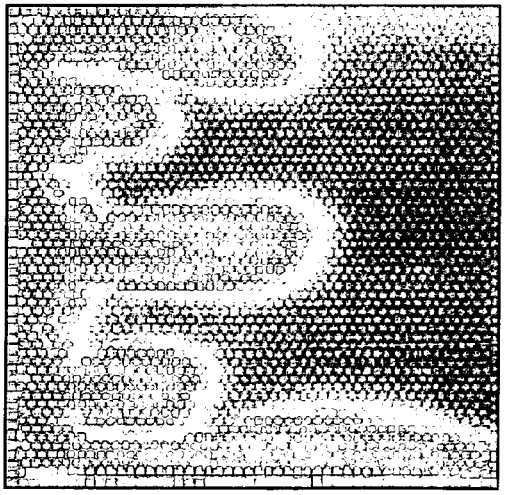
FIG. 2A is an illustration of fingering patterns for a hexagonal grid.
Figure 2B:
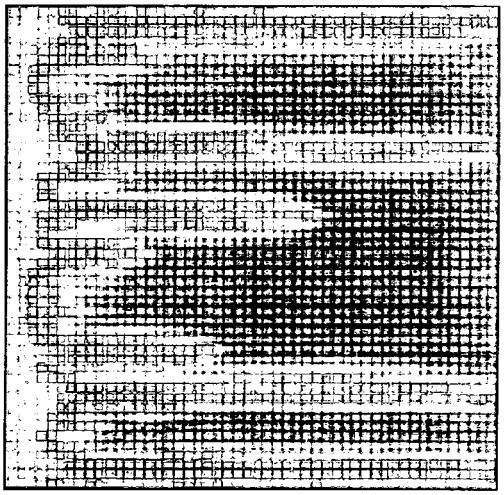
FIG. 2B illustrates the same system of FIG. 2A using a rectangular grid.
Figure 3A:
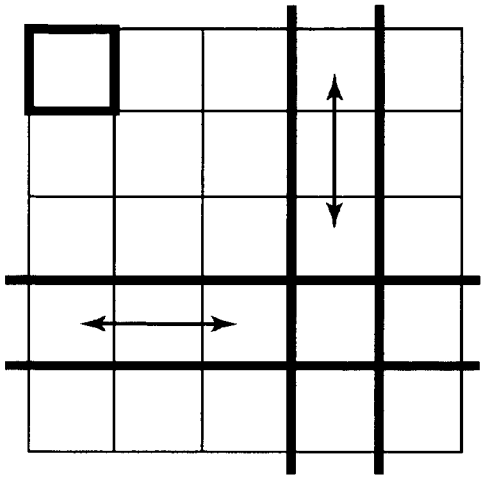
FIG. 3A is an illustration of the principal flow directions in rectangular grids (i.e., 0° and 90°).
Figure 3B:
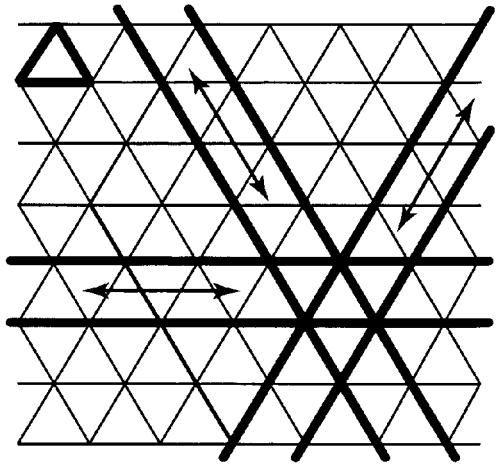
FIG. 3B is an illustration of the principal flow directions in triangular grids (i.e., 0°, 60°, and 120°).

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

This disclosure concerns utilizing a finite-difference grid composed solely or in part a set of contiguous cells having six or more principal flow directions within a single layer to numerically simulate fluid flow in a porous medium. The invention is particularly useful for modeling hydrocarbon reservoir systems that experience viscous fingering due to a displacing fluid having higher mobility than the resident fluid. Mobility ratios greater than one, ten, one hundred, or higher may be simulated. The method may also be particularly useful for certain systems that experience flow channeling for other reasons. In preferred embodiments, some or all of the steps can be computer-implemented. If a computer is used, the software for carrying out any step in the method may reside on a computer readable storage medium, which may or may not be a removable medium. Whether or not a grid is created using a computer, it may be entered into and used with a computer simulation program.

Two specific subclasses of the disclosed finite-difference gridding scheme are described, each having a greater number of principal flow directions than existing gridding schemes, such as rectangular grids (two principal flow directions) or equilateral triangular grids (three principal flow directions). Moreover the two grid subclasses are relatively simple to describe and can, in certain cases if desired, satisfy PEBI (perpendicular bisection) construction requirements. The two subclasses are: (1) bisected periodic grids (BP grids) and (2) substantially-constant width radial grids (SCWR grids).

The grids may be specified in a number of ways, which produce equivalent sets of nodes, cells, and node-node connections. For example, in some embodiments the grids may be specified as a set of node coordinates with cells and node-node connections generated through PEBI grid construction. Alternatively, specific node-node connections may be explicitly specified and cell polygons may be explicitly specified as a set of corner points.

Periodic bisected grids may be formed from simpler structured grids, such as rectangular, triangular, and hexagonal grids. The number of principal flow directions is increased to six or more by adding lines connecting vertices and/or sides to other vertices and/or sides—i.e., bisecting cells. These bisecting lines will form continuous straight lines across the grid with corresponding principal flow directions. In this manner, the number of principal flow directions can be increased to six or more, which is shown to improve the accuracy of simulations in systems experiencing fingering.

The disclosed grids may stand alone or be integrated with other grids. For example, the proposed grids may be embedded in grids of differing styles (e.g., standard rectangular grids, hexagonal grids, or non-periodic grids) or have grids of differing styles embedded in them (e.g., radial grids around a well).

A novel bisected periodic grid is disclosed having six principal flow directions (i.e., 0°, 30°, 60°, 90°, 120°, and 150°). The grid is based on multiply bisected hexagons, illustrated in FIG. 5. The bisected hexagons 501-506 are geometrically equivalent to multiply bisected triangles 510-512. The bisected hexagon grids are composed of triangular cells defined by three lines connecting all opposite vertices and three lines connecting the midpoints of opposite edges of the hexagon. The bisected hexagon grid is particularly well suited for seven-spot well patterns.

Figure 5:
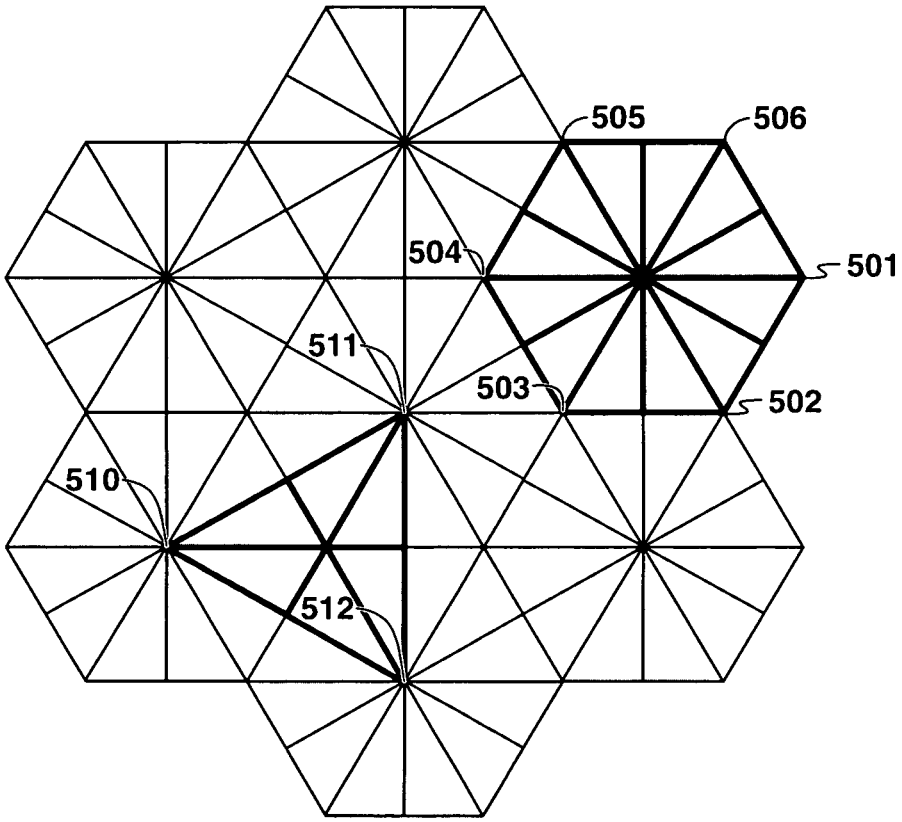
FIG. 5 is an illustration of one embodiment of the disclosed grid with six principal flow directions (i.e., 0°, 30°, 60°, 90°, 120°, and 150°).
Figure 6:
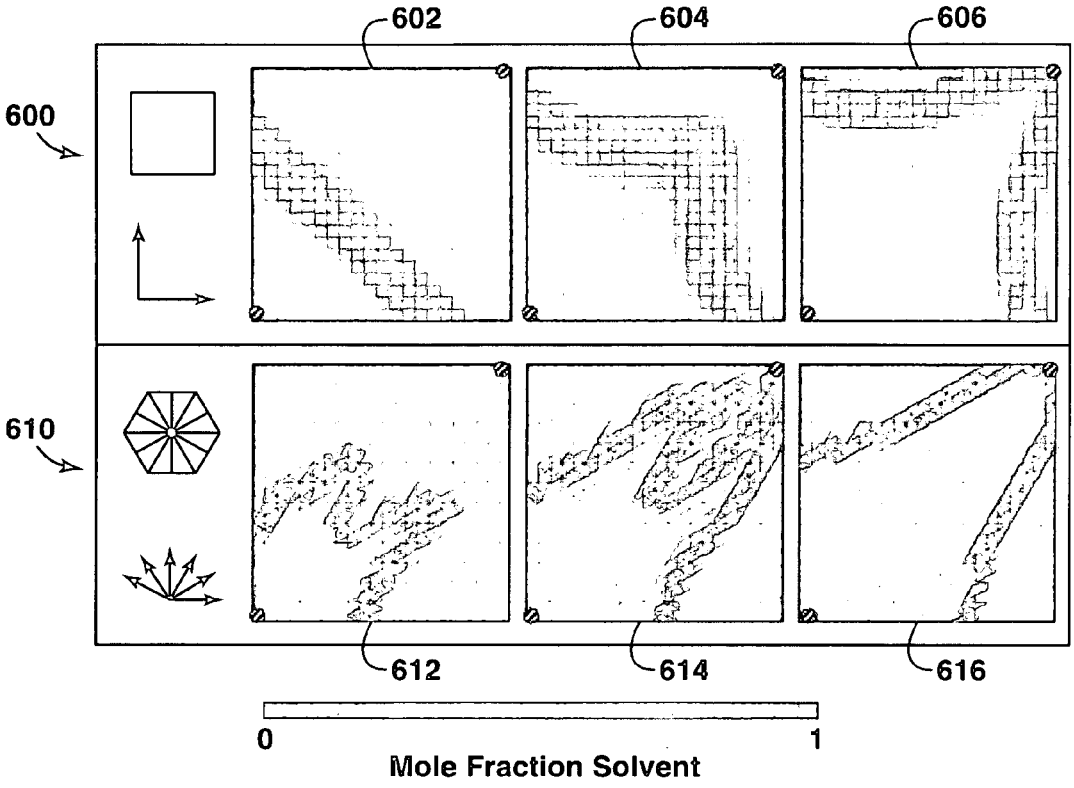
FIG. 6 is a simulation of the displacement of a viscous fluid by a lower viscosity fluid using a rectangular grid and the disclosed grid with six principal flow directions.

The simulation benefit of the novel grid of FIG. 5 is shown in FIG. 6 for the case of flow of a low viscosity fluid displacing a higher viscosity fluid. The simulation shown is one quarter of a standard five-spot pattern with an injection well in the lower left corner and a production well in the upper right corner. FIG. 6 shows results for a rectangular grid 600 and a bisected hexagon grid 610 in accordance with certain embodiments of the present invention. Three different times are shown—i.e., at 25% PVI (Pore Volume Injected) 602, 612, 50% PVI 604, 614, and 100% PVI 606, 616, shown from left to right. The rectangular grid incorrectly shows no fingering behavior until late times. The disclosed bisected hexagonal grid agrees much better with literature results (see, e.g., H. R. Zhang, K. S. Sorbie, and N. B. Tsibuklis, "Viscous fingering in five-spot experimental porous media: new experimental results and numerical simulation", *Chemical Engineering Science,* 52(1), 37-54, 1997).

In the bisected periodic grid types, the cell pattern is composed of triangles. Although triangular grids are well-known, only special grids of the style described here are most suitable for accurately capturing viscous fingering behavior. They have six or more principal flow directions. Indeed triangular grids are often discussed in terms of unstructured (non-periodic) grids. Unstructured grids, unlike the proposed methods, typically have no principal flow directions over any sizeable distance (see, e.g., Chapters 4 and 7 of G. F. Carey, Computational Grids: Generation, Adaptation, and Solution Strategies, 1997).

The bisected hexagon grids are composed of triangular cells defined by three lines connecting all opposite vertices and three lines connecting the midpoints of opposite edges of the hexagon. The bisected hexagon grid is particularly well suited for seven-spot well patterns.

Figure 7:
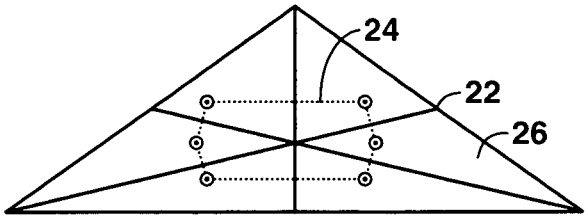
FIG. 7 is an illustration of another embodiment of the disclosed invention with six principal flow directions.

Variations on the grids are possible. For example, the grids may be stretched or compressed in one direction, as shown in FIG. 7. In addition, stretching may be of benefit to maintain the so-called mathematical property of k-orthogonality in systems with anisotropic permeability. K-orthogonality may also be maintained in systems with anisotropic permeability by adjusting the transmissibility across the cell boundaries associated with the outer rectangular faces while maintaining isotropic permeability within the cell (i.e., across the bisection faces). The stretched grid remains a PEBI grid, as illustrated by nodes 22 and connecting lines 24, which are perpendicular to cell sides 26.

In some embodiments, three-dimensional grids may be constructed by orthogonal projection of nodes and cells defined on a two dimensional layer into other layers of differing depths.

Figure 8A:
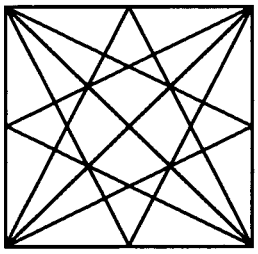
FIG. 8A is an illustration of a multiply bisected square with eight principal flow directions (i.e., 0°, 26.6°, 45°, 63.4°, 90°, 116.6°, 135°, and 153.4°).
Figure 8B:
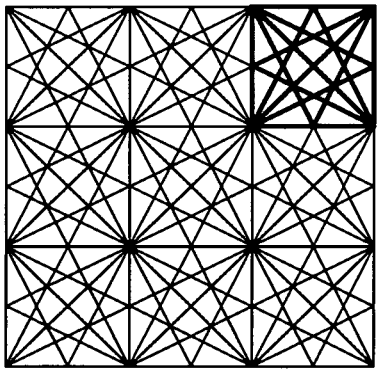
FIG. 8B is an illustration of nine of the same multiply bisected squares together.

More general cell structures with greater numbers of principal flow directions can be constructed where the cells are defined by periodic polygons (e.g., rectangles) divided by two or more lines connecting vertices or points at subdivisions of the edges where the edge is evenly divided into an integer number of subsections and opposite edges are divided in the same manner, as illustrated in FIGS. 8A-8B. Most practically, the integer number of subsections are two (see FIGS. 8A-8B), three, or four. Such structures however are not PEBI constructions and may be incompatible with certain flow simulation software. However, the grids may be applied in more sophisticated simulation software or special purpose software and provide improved estimations of viscous fingering behavior.

Figure 9A:
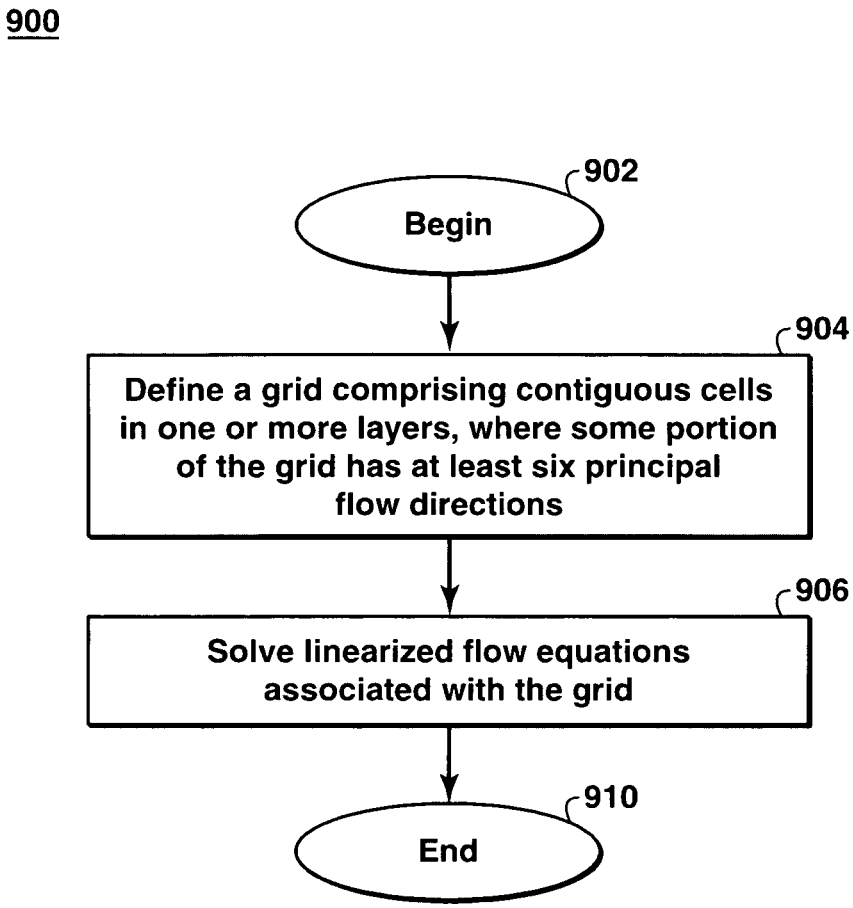
FIG. 9 is a flowchart illustrating the disclosed method of constructing a non-radial grid with six or more principal flow directions.
Figure 9B:
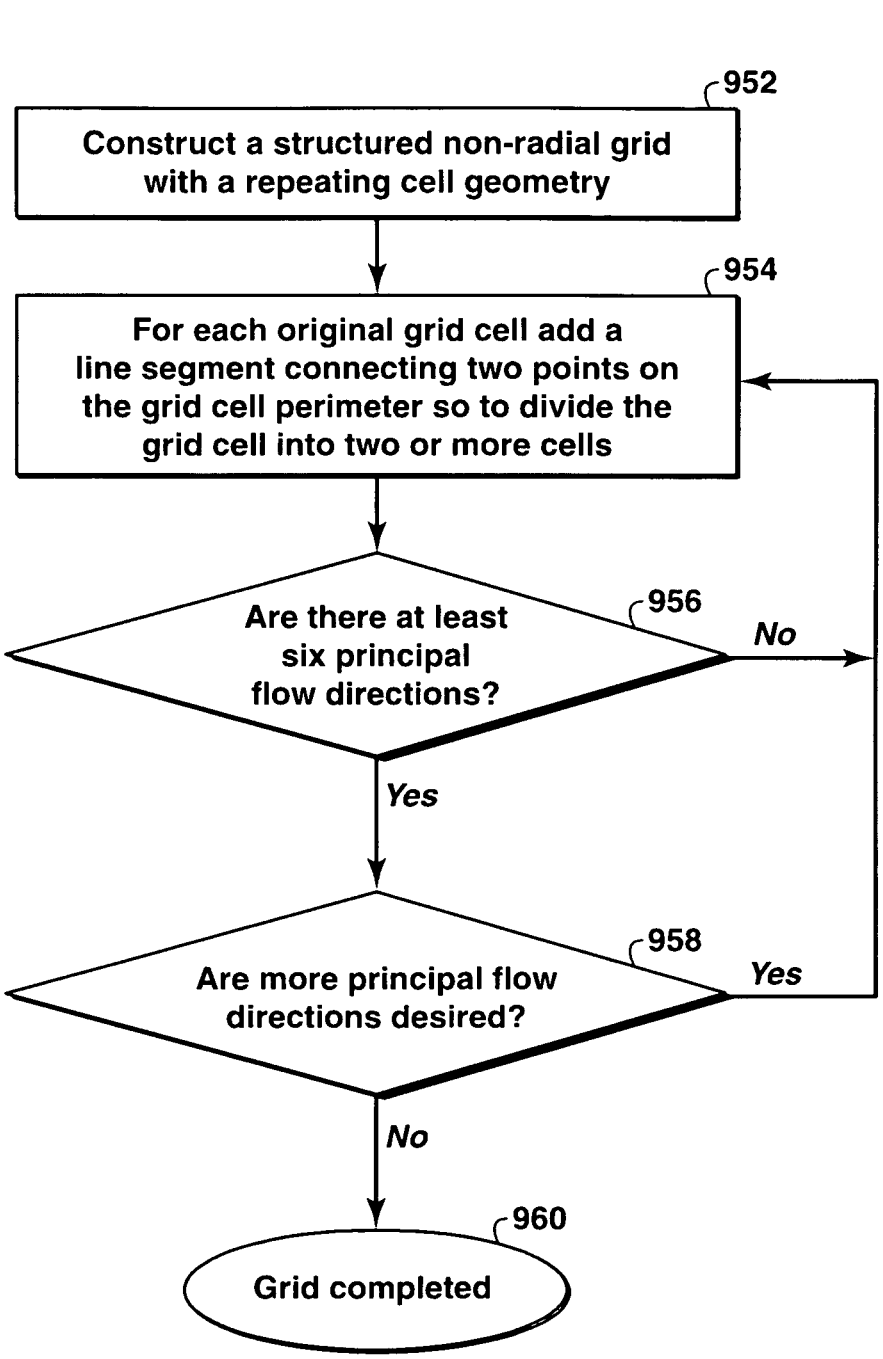

FIGS. 9A-9B illustrate embodiments of methods for creating a grid in accordance with present invention. In FIG. 9A, a method 900 is provided for simulating flow in a porous medium. The method 900 begins at block 902, then includes defining a grid comprising contiguous cells in one or more layers 904, where some portion of the grid has at least six principal flow directions and solving linearized flow equations associated with the grid 906. The method ends at block 908. In exemplary embodiments, the grid may be a bisected periodic grid or a substantially constant width radial grid. The disclosed methods are particularly well adapted for use in modeling flow in hydrocarbon-bearing reservoirs where fingering or channeling is experienced.

In FIG. 9B, a method 950 of constructing a grid for use in numerical simulation is provided. In the method 950, a structured non-radial grid is constructed 952, the grid having a repeating cell geometry, whether or not it has any principal flow directions. Then, for each original grid cell a line segment is added connecting two points on the grid cell perimeter so as to divide the grid cell into two or more cells 954. Preferably, the added line segments will form continuous lines crossing the grid. In block 956, determining whether at least six principal flow directions are present. If not, repeat step 954 until there are at least six principal flow directions. The cell may be segmented as many times as desired to create a total of six or more principal flow directions 958 (including any that were present in the original grid). If more flow directions are desired, repeat step 954 until sufficient, then the grid is complete 960.

Figure 4:
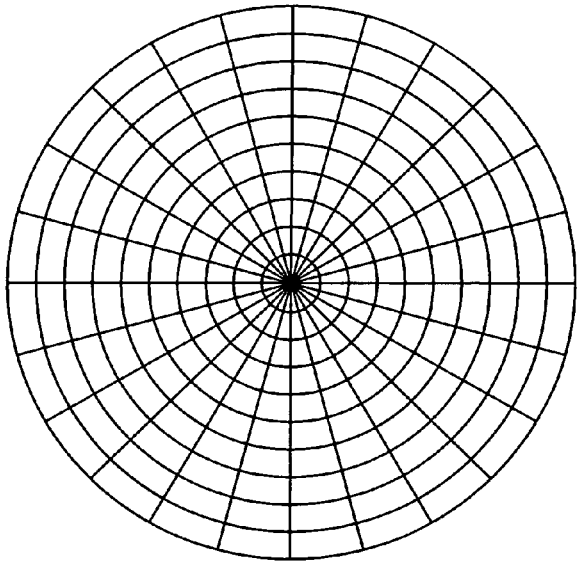
FIG. 4 is an illustration of a standard radial grid.
Figure 10:
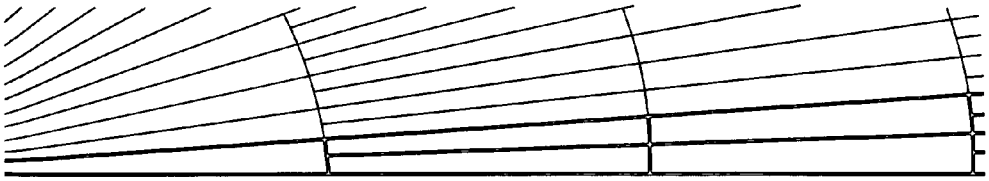
FIG. 10 is a close-up view of a section of another embodiment of the disclosed grid in radial form.

Standard radial grids, as exemplified in FIG. 4, suffer from high lateral dispersion as flow progresses radially, since the cells become increasingly wider. The current invention utilizes a novel grid that maintains a substantially constant cell width with increasing radial position—i.e., radial distance from the center of the radial grid. The disclosed grid is constructed such that radial spokes (i.e., channels) of cells divide into an integer number of two or more spokes when a cell width increases beyond a specified value. In this way, the widths of channels after they initiate maintain a substantially constant width (or at least a variation in width that is limited to a selected value) and hence each channel becomes a principal flow direction. Thus, a radial flow from the center of the grid can travel through a channel of grid cells between radial lines where the channel is of substantially constant width and the flow has no velocity component causing a portion of the flow to cross the channel boundaries. For radial grids, "width" is defined as the distance between adjacent radial lines at a given radial position—i.e., the distance between two points on adjacent radial lines that are equidistant from the center of the radial grid. This distance may be measured as a straight-line or along an arc segment so long as the method of measurement is consistent. The width is "substantially constant" if the ratio of the greatest width—i.e., the point where two adjacent lines are so far apart that a new radial line is begun between them—to the least width—i.e., the point where two adjacent lines are closest to each other, which is usually where one or both of the radial lines is initiated, is about four or less. Preferably this ratio is about two or less. Alternatively, splits may occur at predetermined radial positions. In some embodiments, the approach is to utilize cells of equal radial length and have cell spokes split at radial positions corresponding to $2^n$ rings of cells (i.e., at positions of 2, 4, 8, 16, 32, etc.). Note that radial lines continue outward after they initiate. A radial grid has at least six principal flow directions if at some radial position it is divided enough to contain six principal flow directions even if it has fewer than six at or near its center. Preferably, splits are done such that the cells in any given ring of cells are of equal dimension, but this is not required to practice the invention. FIG. 10 illustrates splits continuing outward after they begin at increasing radial positions.

Figure 11:
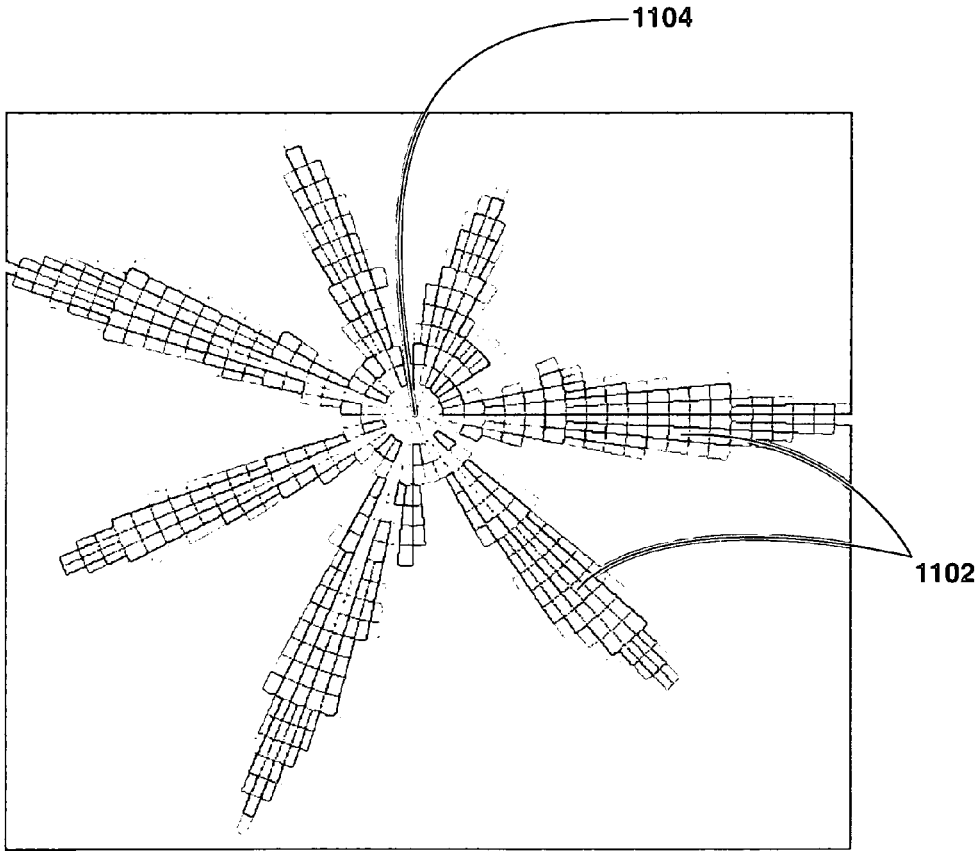
FIG. 11 is a simulation of the displacement of a viscous fluid by a lower viscosity fluid using an embodiment of the disclosed grid in radial form.

An example of simulation results of a system experiencing fingering utilizing the proposed radial grid is shown in FIG. 11. It is noted that the fingers 1102 stay well-defined and have narrow tips even as they flow away from the central injection point 1104. Such would not be the case for a standard radial grid such as that shown in FIG. 4.

In general, two-dimensional grids may be constructed where the node coordinates are defined by the intersection of concentric circles with radial lines extending through two or more concentric circles that start and end on concentric circles. Moreover, when two neighboring radial lines spread greater than a specified width or at predetermined radial positions, the number of radial lines is increased. The radial lines may be, but are not necessarily, evenly spaced circumferentially. Likewise, the concentric circle or ring spacing may be constant, gradually increase or decrease with radial position, or change spacing only at specified radial positions.

Figure 12:
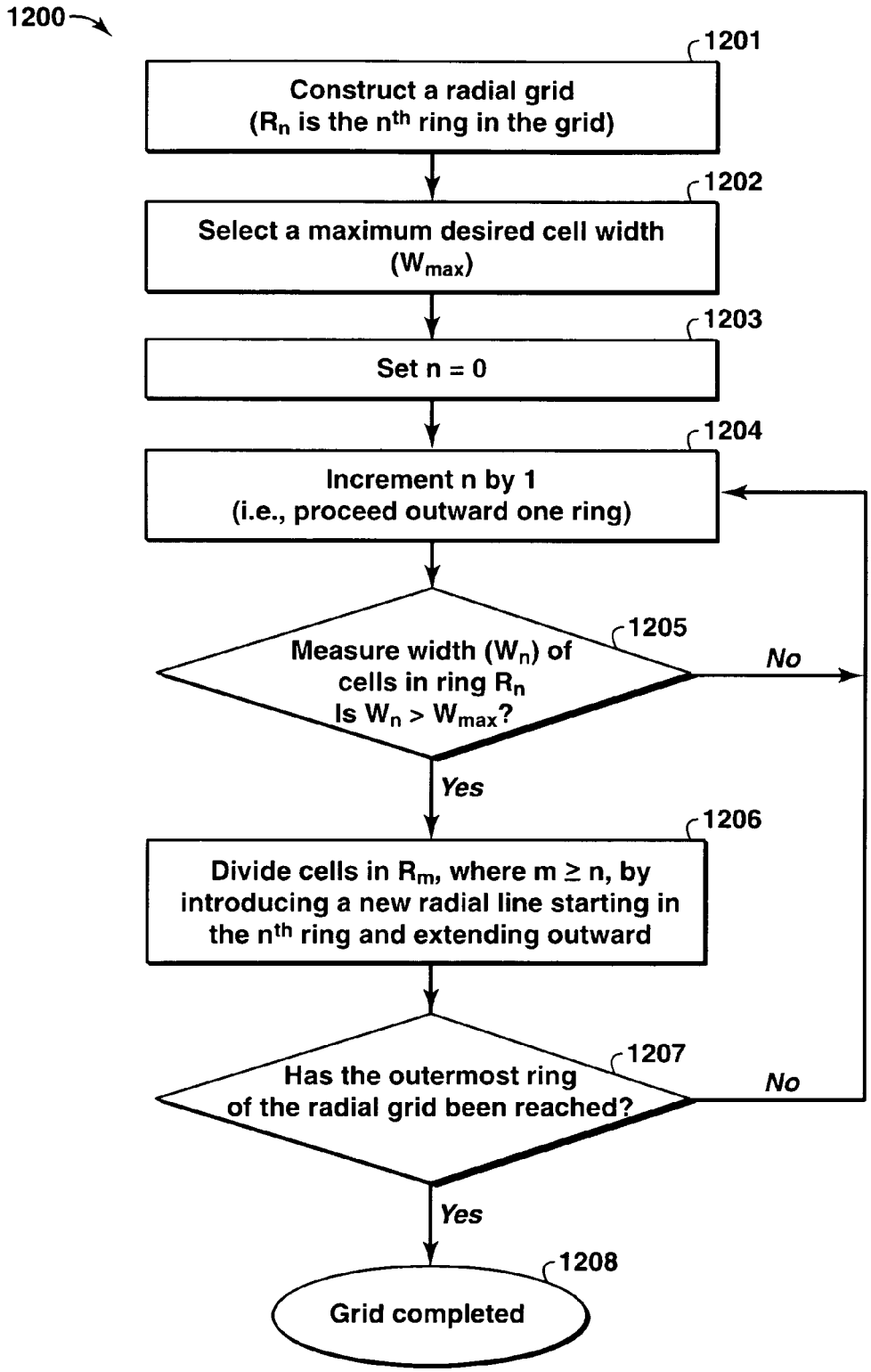
FIG. 12 is a flowchart illustrating the disclosed method of constructing a radial grid with six or more principal flow directions.

FIG. 12 illustrates an embodiment of a method for creating a radial grid 1200. The method begins by constructing a standard radial grid 1201. A maximum desired cell width, $W_{max}$, is then selected 1202. Starting from the center of the grid 1203, rings are considered by stepping outward one ring at a time 1204. For each cell in the ring if the width of a cell in the ring is greater than $W_{max}$ 1205, then a new radial line is introduced starting in the current ring and extending outward which divides the cell into subcells with widths less than $W_{max}$ 1206. When the outmost ring has been rached and all the cells in it considered 1207, the grid is complete 1208. By this method as radial distance from the center of the grid increases, cells are periodically divided with radially extending lines so to maintain cells of substantially constant width.

Dividing lines are continued outward to the edge of the radial grid creating an ever-increasing number of principal flow directions.

Alternate construction methods based on defining cell corners are possible, which lead to geometrically equivalent grids. It is noted that although the grid is defined with concentric circles or rings as guides, the actual cells may be polygons, which approximate circle sections.

Although the present disclosure has been described in detail, it should be understood that various changes, substitutions and alterations can be made thereto without departing from the scope and spirit of the invention as defined by the appended claims.

We claim:

1. A computer implemented method for simulating flow in a porous media, comprising:

(a) constructing a model within the computer of a discretization of space using a grid comprising contiguous cells in one or more layers, at least a portion of the grid having at least six principal flow directions wherein each of the at least six principal flow directions is composed of a channel with a constant width and corresponds to an angle from 0 degrees up to but not including 180 degrees; and (b) solving linearized flow equations utilizing the grid to define the discretization of space, wherein the solving is implemented on the computer.

2. The method of claim 1, wherein the grid is a bisected periodic grid.

3. The method of claim 2, wherein the bisected periodic grid is formed from structured PEBI grids.

4. The method of claim 2, wherein the grid is based on multiply bisected hexagons.

5. The method of claim 2, wherein the grid is stretched or compressed in one direction.

6. The method of claim 2, wherein the grid further comprises periodic polygons divided by two or more lines connecting points wherein the points are located at subdivisions of edges and wherein each of the edges is equally divided into an integer number of subsections and opposite edges are divided into the same integer number of subsections.

7. The method of claim 6, wherein the integer number of subsections is two, three, or four.

8. The method of claim 1, wherein the linearized flow equations describe displacement of a reservoir fluid by a displacement fluid and the displacement fluid to reservoir fluid mobility ratio is greater than one.

9. The method of claim 1, further comprising forming a second grid having less than six principal flow directions and combining the second grid with the grid having six or more principal flow directions.

10. A computer implemented method for simulating flow in a porous media, comprising:

(a) constructing a model within the computer of a discretization of space using a structured non-radial grid and for each original grid cell adding a line segment connecting two points on a grid cell perimeter so to divide the grid cell into two or more cells such that there are at least six principal flow directions across the structured non-radial grid wherein each of the at least six principal flow directions is composed of a channel with a constant width and corresponds to an angle from 0 degrees up to but not including 180 degrees; and (b) performing a simulation on the computer of flow in a porous media wherein the simulation comprises solving linearized flow equations utilizing the structured non-radial grid to define the discretization of space.

11. The method of claim 10, wherein the cells being divided are hexagonal and the added line segments connect opposite vertices.

12. The method of claim 10, wherein the cells being divided are rectangular and the added line segments connect points that are located at subdivisions of the edges where each of the edges is divided into an integer number of subsections.

13. The method of claim 10, further comprising forming a second grid having less than six principal flow directions and combining the second grid with the grid having six or more principal flow directions.

14. A computer implemented method for simulating flow in a porous media, comprising:

(a) constructing a model within the computer of a discretization of space using a radial grid having a center point and at least an innermost ring and at least one additional ring, each ring having a plurality of cells, wherein the cells have at least a cell width, wherein each ring other than the innermost ring has an equal or greater number of cells than its neighboring inside ring, wherein at least one ring other than the innermost ring has a greater number of cells than its neighboring inside ring, wherein the constructing is performed by:

selecting a maximum cell width ($W_{max}$);

performing a calculation within the computer to determine if a cell has a width greater than $W_{max}$, wherein the determination is made one ring at a time starting at the ring closest to the center point of the radial grid; and if a cell has a width greater than $W_{max}$, modifying the model within the computer of the radial grid by introducing a new radial line starting from the ring having a cell with a width greater than $W_{max}$ and extending radially outward; and (b) performing a simulation on the computer of flow in a porous media wherein the simulation comprises solving linearized flow equations utilizing the radial grid to define the discretization of space.

15. The method of claim 14, wherein the new radial line extends to an outermost edge of the radial grid, and wherein the determining step is repeated for each ring until the ring at the outermost edge of the radial grid is reached such that each of the plurality of cells in each of the at least one ring has a cell width less than $W_{max}$.

16. The method of claim 10, further comprising solving linearized flow equations associated with the structured non-radial grid, wherein the linearized flow equations describe displacement of a reservoir fluid by a displacement fluid and the displacement fluid to reservoir fluid mobility ratio is greater than one.

17. The method of claim 15, further comprising solving linearized flow equations associated with the radial grid, wherein the linearized flow equations describe displacement of a reservoir fluid by a displacement fluid and the displacement fluid to reservoir fluid mobility ratio is greater than one.

* * * * *